United States Patent [19]

Dadbeh

[11] Patent Number: 4,798,381

[45] Date of Patent: Jan. 17, 1989

[54] BASKETBALL GOAL HEIGHT ADJUSTMENT APPARATUS

[75] Inventor: Bemanali H. Dadbeh, Seal Beach, Calif.

[73] Assignee: Harvard Sports, Inc., Compton, Calif.

[21] Appl. No.: 69,882

[22] Filed: Jul. 6, 1987

[51] Int. Cl.[4] ..... A63B 63/08

[52] U.S. Cl. ..... 273/1.5 R; 248/284; 248/542

[58] Field of Search ..... 273/1.5 R; 248/284, 248/542

[56] References Cited

U.S. PATENT DOCUMENTS

| | | | |
|---|---|---|---|
| 2,193,272 | 3/1940 | Crossley | 248/542 X |
| 2,506,824 | 5/1950 | Brown et al. | 248/542 X |
| 2,986,395 | 5/1961 | Sheftel | 273/1.5 R |
| 3,175,396 | 3/1965 | Kock | 248/542 X |
| 3,462,102 | 8/1969 | Rivers | 248/284 X |
| 3,586,324 | 6/1971 | Bearson | 248/284 X |
| 3,802,702 | 4/1974 | Pulley | 248/284 X |
| 4,330,101 | 5/1982 | Anderson | 248/284 |
| 4,395,040 | 7/1983 | White | 273/1.5 R |

FOREIGN PATENT DOCUMENTS

| | | | |
|---|---|---|---|
| 576890 | 6/1976 | Switzerland | 248/284 |

*Primary Examiner*—Paul E. Shapiro

*Attorney, Agent, or Firm*—Irving Keschner

[57] ABSTRACT

Basketball goal height adjustment apparatus comprising a three dimensional parallelogram having nominally parallel but adjustable parallelogram bars. A mounting member is secured to the rear surface of the basketball backboard and coupled to a frame to which the parallelogram bars are also attached. A notched bracket member is secured to the mounting member and a bifurcated member, one end of the bifurcated member including a spring loaded pin which is operatively biased into engagement with a selected one of said notches, each notch corresponding to a predetermined vertical height of the goal. A device for visually indicating the height of the goal is also provided. To adjust the goal height, the bifurcated member (or the backboard) is pushed such that the pin moves away from the notch. The backboard is then moved to the desired height at which time the force is removed from the bifurcated member, the pin being positioned by the compressive force of the spring into the notch corresponding to the desired goal height.

14 Claims, 2 Drawing Sheets

FIG. 1
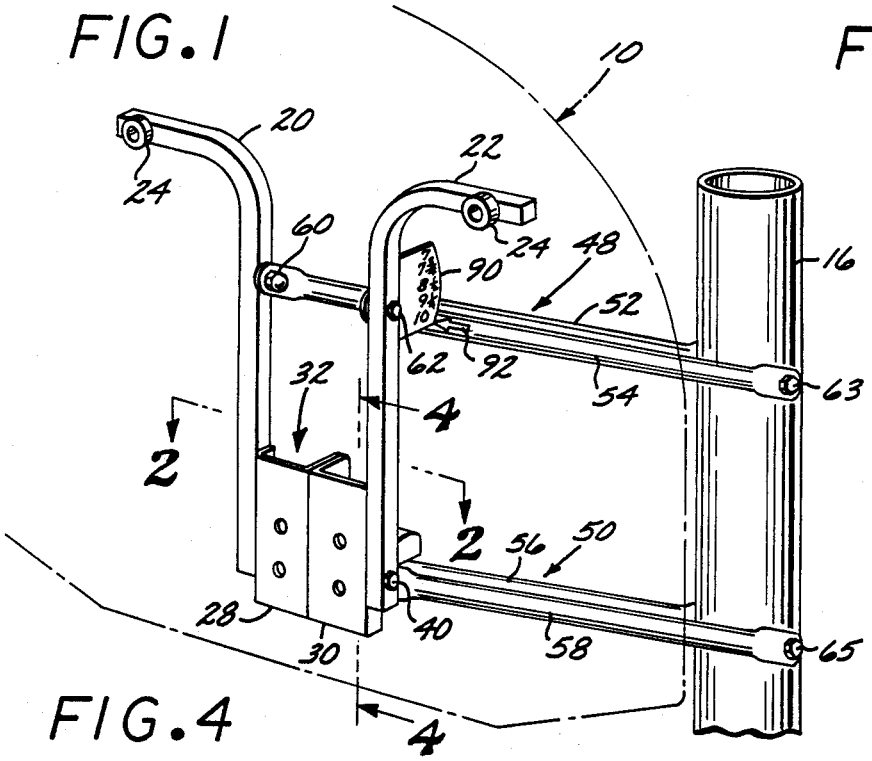
FIG. 2
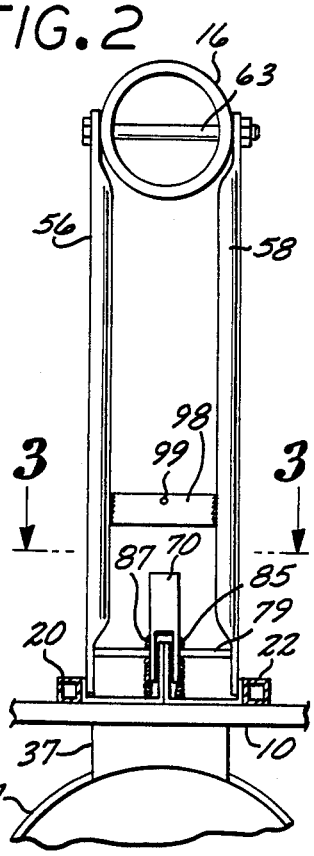
FIG. 4
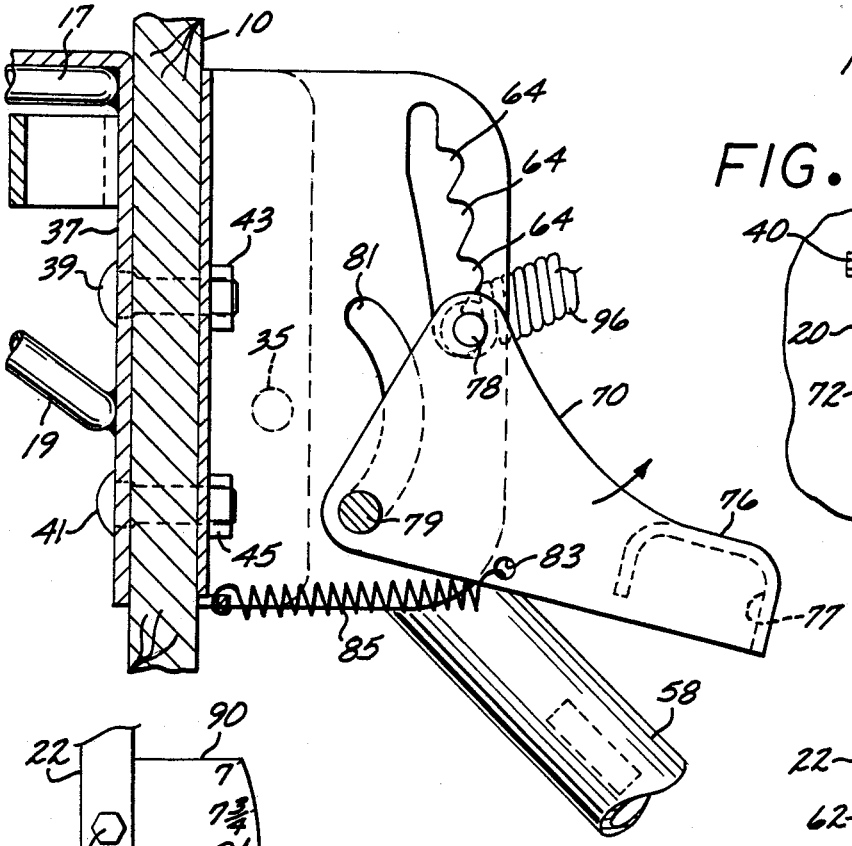
FIG. 3
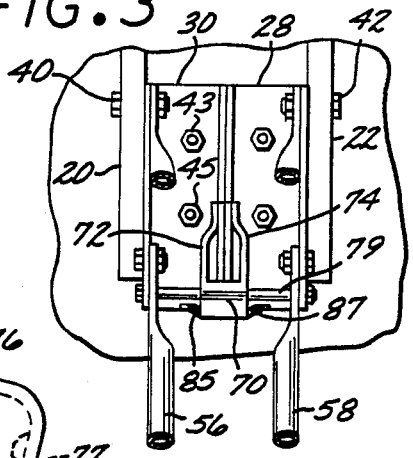
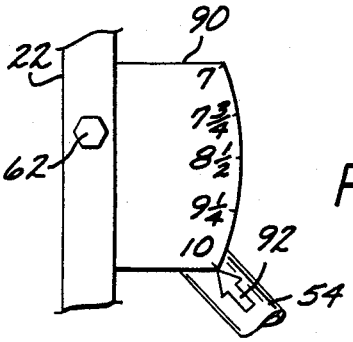
FIG. 5
FIG. 6
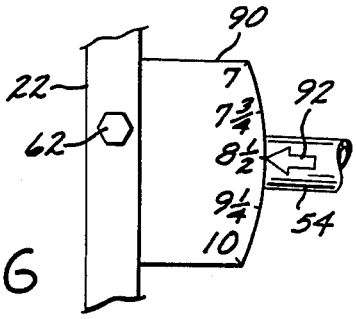

BASKETBALL GOAL HEIGHT ADJUSTMENT APPARATUS

BACKGROUND OF THE INVENTION

1. Field of the Invention

The present invention relates to adjustable basketball goal height devices and, in particular, a device which includes a visual indication of the goal height.

2. Description of the Prior Art

The desirability of providing a basketball stand whereby the height of the goal can be adjusted to accommodate children of various heights has been well known in the sports toy industry. A number of devices for adjusting goal heights have been disclosed in the prior art. Typical of these devices are those disclosed in the following United States patents: U.S. Pat. No. 4,526,367 to Haston et al, this patent disclosing a portable basketball assembly which utilizes a single wrench cable to move a basketball goal to a regulation playing height and also to intermediate playing heights; U.S. Pat. No. 4,508,337 to Gillespie, this patent disclosing a basketball goal height reducing device for both securing an auxiliary basketball goal/backboard assembly at a lower height with respect to a primary basketball goal/-backboard assembly; U.S. Pat. No. 3,802,702 to Pulley, this patent disclosing a basketball hoop and board support structure which includes a telescoping brace structure to hold a parallelogram structure in a predetermined position; U.S. Pat. No. 3,765,676 to Bearson et al, this patent disclosing a basketball goal which can be vertically adjusted by means of a screw member: U.S. Pat. No. 3,586,324 to Bearson, this patent disclosing an adjustable basketball goal wherein a cable/pulley arrangement and associated stop means are utilized to provide for vertical height adjustment: U.S. Pat. No. 2,916,288 to Chervenka, this patent disclosing means for adjusting the height of a backboard by utilizing a screw member and associated support members; U.S. Pat. No. 4,395,040 to White, this patent disclosing a basketball goal mounted on a parallelogram supporting structure, the goal being raised or lowered by threaded members between portions of the supporting structure; U.S. Pat. No. 4,643,422 to Cramblett, this patent disclosing a basketball backboard adjustment operable to adjust the height of a basketball goal which utilizes a track-carriage device for moving the goal vertically, a user operated screw moving the carriage along the track to a predetermined position: U.S. Pat. No. 4,522,394 to Broussard, this patent disclosing a health-sports apparatus which includes a rim and backboard the height of which can be adjusted by means of a plurality of ratchets; and U.S. Pat. No. 4,330,101 to Andersen, this patent disclosing a basketball hoop height adjustment structure and similar to the one disclosed in U.S. Pat. No. 3,802,702 and further including a device for braking backboard support structure descents.

Although the aforementioned devices all provide various features for adjusting the height of a basketball backboard and hoop, they generally incorporate relatively expensive mechanical components many of which are subject to periodic breakdowns. In addition, none of the prior art references noted above provide a visual indication of the goal height as the adjustment is being made.

SUMMARY OF THE PRESENT INVENTION

The present invention provides an improved apparatus for adjusting the height of a basketball goal, the apparatus including a visual indication of the height of the basketball goal.

A three dimensional parallelogram structure having nominally parallel but adjustable arms is coupled to the rear surface of the basketball backboard via a mounting member, a notched bracket member also being secured to the mounting member. One end of a bifurcated member is pivotally secured to two arms of the parallelogram structure via a bolt, a spring loaded pin joining the bifurcated arms of the member, the pin passing through the slot forming cutout portion of the bracket. The bifurcated member is operatively biased into engagement with a selected one of said notches, each notch corresponding to a particular vertical height of the goal. A device is coupled to the apparatus such that a visual indication of the goal height is provided. To adjust the goal height, the bifurcated member is pushed such that the pin is released from the notch it is positioned in, the backboard then being moved to the desired height as evidenced by the indicating device. The force is then removed from the bifurcated member, the pin then being moved by the compressive force of the spring into the notch corresponding to the height selected.

The present invention thus provides a simplified and relatively inexpensive apparatus for adjusting the height of a basketball goal. The apparatus can be easily mounted to existing basketball backboard and pole structures and utilizes relatively few mechanical components which are structurally sound and easily fabricated. A visual indicator is provided so that a user can see what the height of the goal will be as the adjustment is being made. A special tool is not required to raise or lower the backboard, the positioning of the backboard being accomplished in a relatively rapid manner. A counterweight spring is provided to enable the backboard/goal to be raised or lowered with a reduced effort, an important consideration for the user of the apparatus.

BRIEF DESCRIPTION OF THE DRAWING

For a better understanding of the invention as well as other objects and further features thereof, reference is made to the following description which is to be read in conjunction with the accompanying drawing wherein:

FIG. 1 is a perspective front view of the apparatus of the present invention showing a conventional basketball backboard;

FIG. 2 is a view along line 2—2 of FIG. 1;

FIG. 3 is a view along line 3—3 of FIG. 2:

FIG. 4 is a sectional view along line 4—4 of FIG. 1;

FIG. 5 is a view showing the visual indicator device utilized in the present invention with the goal raised to its maximum height;

FIG. 6 is a view showing the visual indicator device utilized in the present mention with the goal raised to mid-height.

DETAILED DESCRIPTION OF THE INVENTION

FIG. 1 illustrates a conventional design of a basketball game which includes a backboard 10 (shown in phantom) which mounts a hoop 17 (shown in FIG. 4) and a net (not shown). In normal (non-adjustable) use, this type of goal is mounted on a mounting standard, such as a freestanding pole, or the wall or roof of a building.

Figure 7:
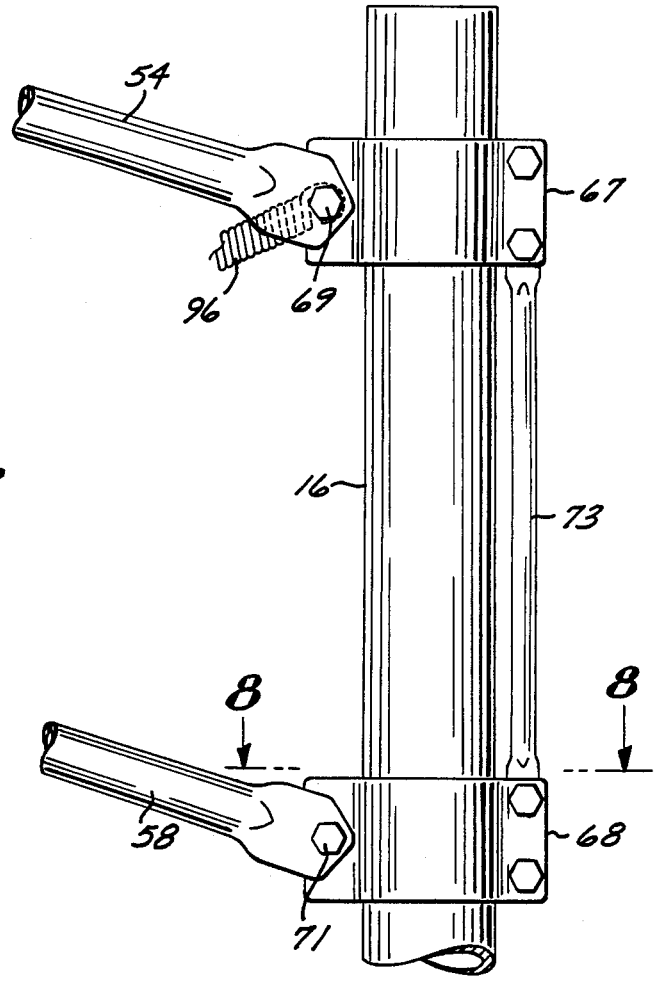
FIG. 7 shows the adjustable clamp member for coupling the apparatus to a vertical member.
Figure 8:
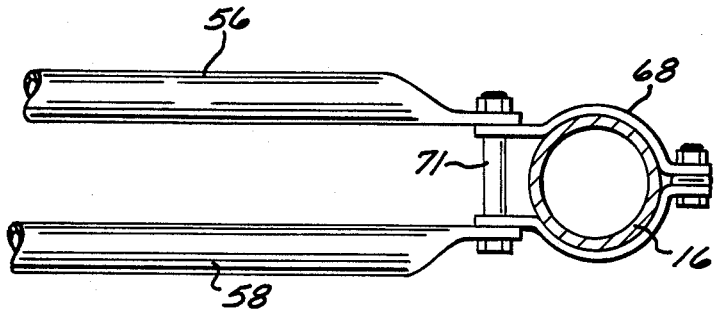
FIG. 8 is a view along line 8—8 of FIG. 7.

In accordance with the teachings of the present invention, the basketball backboard adjustment apparatus is disposed between the backboard 10 and the standard (a pole 16, as shown in FIGS. 1 and 2, for example) engaging the set of mountings on each. The apparatus includes two "L" frame, or brace, members 20 and 22 attached at one end to the rear surface of backboard 10 via a pair of screws (not shown) and plastic spacers 24. The other end of each brace member 20 and 22 is attached to two half brackets 28 and 30 forming a bracket assembly 32, the half brackets being joined together by a bolt 35. Brackets 28 and 30 are secured to backboard 10 and hoop mounting plate 37 via four bolts and their associated nuts, two bolts 39 and 41, and nuts 43 and 45, respectively being illustrated in FIG. 4. The lower portion of each brace is coupled to assembly 32 via two bolts and 42. Hoop, or rim, 17 is secured to bracket 37 and member 19 is utilized to support hoop 17 (support connection not shown in figure). A force receiving member 21 is mounted to backboard 10 as illustrated. The apparatus further includes a parallelogram structure having two sets of parallelogram bars, or arms, 48 and 50, each set comprising bars 52 and 54 and 56 and 58, respectively. One end of the bars 56 and 58 are inserted between braces 20 and 22 and brackets 28 and 30, respectively, in a manner such that bolts 40 and 42 secure together these three components in a pivotable manner. One end of each of the two upper bars 52 and 54 are pivotally coupled to corresponding braces 20 and 22 via two bolts 60 and 62. The other end of bars 52, 54, 56 and 58 are pivotally mounted to pole 16 by bolts 63 and 65 as illustrated. In an alternate arrangement, the end of the bars are coupled to clam type brackets 67 and 68 as shown in FIGS. 7 and 8 via an adjustable pair of bolts 69 and 71, respectively. The other end of brackets 67 and 68 are fixedly secured to a rigid bar member 73. Member 73 assures that when the brackets 67 and 68 are secured to pole 16 that the parallelogram arms are spaced apart the correct distance before bolt pairs 69 and 71 are tightened, thus enabling proper operation of the apparatus. As noted previously, the bar ends could also be attached to a wall or roof.

The bracket assembly 32 includes an opening having a plurality of notches 64 formed therein as shown in FIG. 4 (since five height positions are provided in the embodiment illustrated, an additional notch, omitted for the purposes of clarity, would be provided). A bifurcated member 70 comprises two forward arm portions 72 and 74 and a rear portion 76 having an indented area 77 designed to receive a force transmitting member, such as a broom pole handle. A pin 78 is mounted to each arm of member 70 and is arranged to pass through the notch containing opening of bracket assembly 32. The bifurcated member 70 is pivotably mounted to bracket assembly 32 by a bolt member 79, member 70, bolt member 79 and the parallogram arms pivotably moving within slot 81. Member 70 includes two holes (only hole 83 shown) to receive one end of each of two springs 85 and 87, the other ends of the springs being coupled to a respective one of brackets 28 and 30 in a manner such that the pin is positioned to normally engage one of the notches by the compressive force of the springs.

A height detector, or indicator, plate 90 is pivotally mounted to brace 22 by bolt 62. Plate 90 includes a plurality of visual indicia on the surface of the plate which corresponds to the height of the basketball goal which in turn, is determined by the notch in which the pin rests. An arrow, 92, preferably colored red, is formed on arm 54 and is arranged to point at the indices indicating the goal height. Referring to FIG. 5, arrow 92 is shown as pointing to the number "10", indicating that the goal is 10 feet, the highest goal position available. FIG. 6 illustrates arrow 92 pointing to the number "8½", corresponding to a goal height of 8.5 feet, the mid-height goal position.

The plate 90 is positioned such that the person adjusting the goal height can see the indicia on plate 90 and arrow 92 as the adjustment is being made. It should be noted that the arrow/plate arrangement (or any corresponding visual indicating device) can be located in positions different than that shown in the figures.

A spring 96 is also provided to act as a counterweight (to relieve the strain on a user as the goal is lowered) and/or an additional compressive force to force pin 78 into a selected notch, depending upon how spring 96 is attached. In the embodiment illustrated, spring 96 is connected at one end to pin 78 and the pole 16 at the other end. In this configuration, spring 96 functions both as a counterweight and to provide an additional compressive force. If the end is connected to support bracket 98 in hole 99 instead of pin 78, spring 96 acts primarily as a counterweight as a user lowers the goal. In essence, the counterweight spring 96 works against the weight of the backboard and goal, thus allowing less force to be used to both raise and lower the goal. By selecting different attachment points, the counterweight force can be adjusted to correspond to the weight of the backboard and goal i.e. in the connection illustrated the force is greater than if the connection was made to bracket 98.

To adjust the goal height to a lower level, sufficient force is exerted in member 77 (FIG. 4), such as with a broom handle, to move the pin away from its current notch and the backboard is lowered to the desired height as noted by the position of arrow 92. When this position is reached, the pin is positioned by the compressive force of the springs into the corresponding notch. To raise the goal to its desired height, sufficient force is exerted under member 21, the pin 78 moving upward in and out of the notches. When the pin is adjacent the notch corresponding to the desired height, the force is removed and pin 78 is forced into that notch by springs 85 and 87 (and spring 96 if connected appropriately).

The present invention thus provides a basketball goal height adjusting apparatus which provides significant improvements over the prior art devices, particularly in the provision of a device which allows the person doing the height adjustment to visually ascertain the current height of the goal as the adjustment is being made.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A basketball backboard adjustment apparatus for varying the height of a basketball backboard and hoop comprising:

first and second frame members each secured at one end to the rear surface of said backboards;

first and second sets of parallelogram bars respectively disposed on opposite sides of said and pivotally coupled to said first and second frame members respectively, each set of parallelogram bars comprising first and second bar members;

a bracket assembly having first, second and third portions, said first portion being secured to the rear surface of said basketball backboard, said second portion being affixed to said first frame member and said third portion being affixed to said second frame member; said bracket assembly including a member having an opening and extending in a direction away from said first portion of said bracket assembly, said opening having a plurality of notches formed therein;

a bifurcated member having two arm portions separated by a gap;

a pin member extending between said bifurcated arm members through said opening; and means for pivotally securing said bifurcated member to one bar of said first set of parallelogram bars and a corresponding bar of said second set of parallelogram bars.

2. The apparatus of claim 1 wherein said pin is positioned in a first of said plurality of notches corresponding to a desired height of said basketball backboard and hoop.

3. The apparatus of claim 1 further including an indicating device associated with said apparatus to provide a visual indication of the height of the basketball backboard and hoop.

4. The apparatus of claim 3 wherein the visual indication of height corresponds to the notch in which the pin member is positioned.

5. The apparatus of claim 3 wherein said indicating device comprises a plurality of visible indicia marked on a plate member secured to said apparatus and adjacent to one of said parallelogram bars.

6. The apparatus of claim 5 wherein an indicating marker is formed on said parallelogram bar, said marker being arranged to point to said indicia as the height of said backboard is adjusted.

7. The apparatus of claim 1 further including a fixed member and means for pivotably securing said parallelogram bars to said fixed member.

8. The apparatus of claim 7 wherein said fixed member comprises an upright elongated member.

9. The apparatus of claim 8 wherein said securing means comprises adjustable clamp members.

10. The apparatus of claim 8 wherein said securing means comprises at least two spaced apart clamp members, the ends of each clamp member being maintained a fixed distance apart.

11. The apparatus of claim 7 further including spring means coupling said backboard adjustment apparatus to said fixed member, said spring means providing a counterweight to said backboard.

12. The apparatus of claim 1 wherein said bifurcated member includes a force receiving portion.

13. The apparatus of claim 1 wherein said pin member is spring biased into a selected notch.

14. The apparatus of claim 1 further including spring means coupled to said bifurcated member for positioning said pin member into engagement with one of said notches.

* * * * *